US006866446B2

(12) United States Patent
McAllister et al.

(10) Patent No.: US 6,866,446 B2
(45) Date of Patent: Mar. 15, 2005

(54) REVETMENT BLOCK AND MAT

(75) Inventors: Kenneth L. McAllister, Bowling Green, KY (US); Kenny W. McCoy, Morgantown, KY (US); Derek W. Dice, Bowling Green, KY (US)

(73) Assignee: Lee Masonry Products, LLC, Bowling Green, KY (US)

( * ) Notice: Subject to any disclaimer, the term of this patent is extended or adjusted under 35 U.S.C. 154(b) by 0 days.

(21) Appl. No.: 10/068,324

(22) Filed: Feb. 5, 2002

(65) Prior Publication Data

US 2003/0147705 A1 Aug. 7, 2003

(51) Int. Cl.[7] ..... E02B 3/12

(52) U.S. Cl. ..... 405/16; 405/17; 405/19; 405/20

(58) Field of Search ..... 405/20, 19, 17, 405/16, 15, 302.4, 302.6

(56) References Cited

U.S. PATENT DOCUMENTS

| | | | | | |
|---|---|---|---|---|---|
| 953,051 | A | * | 3/1910 | De Muralt | 405/16 |
| 1,045,328 | A | | 11/1912 | Sammis | |
| 1,772,821 | A | * | 8/1930 | Webber | 405/20 |
| 2,605,681 | A | | 8/1952 | Trief | |
| 3,903,702 | A | | 9/1975 | Appleton | |
| 3,923,410 | A | | 12/1975 | Jordan et al. | |
| 4,227,829 | A | | 10/1980 | Landry, Jr. | |
| 4,370,075 | A | | 1/1983 | Scales | |
| 4,465,398 | A | * | 8/1984 | Knudsen | 405/16 |
| 4,499,664 | A | | 2/1985 | Scales | |
| 4,564,111 | A | | 1/1986 | Suttles | |
| 4,564,311 | A | * | 1/1986 | Scales | 405/20 |
| 4,813,812 | A | * | 3/1989 | Hasegawa et al. | 405/16 |
| 4,919,565 | A | | 4/1990 | Gopfert | |
| 5,484,230 | A | | 1/1996 | Rudloff | |
| 5,779,391 | A | | 7/1998 | Knight | |
| D399,577 | S | | 10/1998 | Scales | |
| 5,906,456 | A | | 5/1999 | Knight | |
| 5,921,710 | A | | 7/1999 | Scales | |

* cited by examiner

*Primary Examiner*—Frederick L. Lagman
(74) *Attorney, Agent, or Firm*—John F. Salazar; James E. Cole; Middleton Reutlinger

(57) ABSTRACT

A revetment block for use forming an articulating revetment mat. The revetment block has first and second ends and first and second sidewalls. The sidewalls have a first lower vertical surface, first and second upper vertical surfaces, and transition surfaces between the upper and lower vertical surfaces. The sidewalls define interlocks which extend outward from the sidewalls and are either normal to the upper vertical surfaces or angled. The sidewalls also design corner spaces comprising a transition surface and at least on vertical surface for operably communicating with an interlock. The revetment block may also comprise a plurality of ducts extending therethrough as well as a dome extending from the top surface of the revetment block. The revetment block may also comprise at least one aperture extend vertically through the block. The aperture may have tapered walls.

38 Claims, 9 Drawing Sheets

REVETMENT BLOCK AND MAT

BACKGROUND OF THE INVENTION

1. Technical Field of the Invention

The present invention relates generally to a revetment block. More particularly, the invention relates to a revetment block, used to form a revetment mat having interlocking qualities which inhibit vertical hydraulic lifting forces as well as inhibiting motion in longitudinal and latitudinal directions. Additionally, a revetment mat is disclosed being formed of the above described revetment block thus inhibit upward thrust on the mat.

2. Description of the Related Art

Revetment mats are used to inhibit soil erosion from areas of flowing water along, for instance, shorelines, spillways, overflow channels, drainage channels, boat ramps, and the like. Current revetment mats are formed from articulated concrete blocks that interlock together and conform to specific hydraulic performance characteristics.

In U.S. Pat. No. 4,370,075, issued to Scales, FIGS. 1 and 6 show a common characteristic of revetment mats. FIG. 6 shows a perspective view of a revetment block having a plurality of protrusions which may be slidably positioned within a similarly shaped channel of an adjacent block. As viewed in FIG. 1, it is clear that the blocks would be susceptible to hydraulic lift without the use of a cable because the blocks alone have no feature which inhibits upward motion.

This problem also exists in the U.S. Pat. No. 5,779,391, issued to Knight. Viewing FIG. 1 and FIG. 16A, in combination, a block is shown having protrusions extending from the block side surfaces which slidably engage channels formed in adjacent blocks. Without cabling extending through the revetment mat, the blocks would also be susceptible to vertical lifting forces.

Cable or rope may be disposed through the blocks of a revetment mat in order to prevent upward lift, for instance as shown in the above mentioned references. However, often the cable may fray and break due to corrosion, rot, marine organisms and the like. Once the revetment mat is positioned in a waterway it is very difficult to replace the cable or rope. Moreover, it is difficult to remove the revetment mat from the waterway since the cables generally support the mattress during lifting.

In view of the deficiencies in known revetment blocks, it is apparent that a revetment block is needed for use with a revetment mat having a design which inhibits uplift of the revetment block and does not rely on a cable to inhibit hydraulic lift of the revetment block and necessarily the revetment mat.

SUMMARY OF THE INVENTION

It is an object of the present invention to provide a revetment block having interlocks for use in forming a revetment mattress.

It is a further objective of this invention to provide a revetment block having interlocks which inhibits upward hydraulic thrust of adjacent revetment blocks of a revetment mattress.

It is an even further objective of this invention to provide a revetment block which may connect with adjacent blocks of a revetment mattress by rope or cable to inhibit upward hydraulic thrust.

It is still an even further objective of this invention to provide a revetment block having at least one dome which slows the velocity of water passing above the revetment mat.

It is yet an even further objective to provide a revetment block having a plurality of apertures or holes extending therethrough for foliage growth.

It is also an object of the present invention to provide a revetment block having sidewalls including vertical and inwardly and outwardly extending surfaces.

A revetment block, comprising a substantially rectangular block including a first sidewall and a second sidewall each having a first lower vertical surface and a first and a second upper vertical surface. The first lower vertical surface, offset from said first upper vertical surface, has tapered transition surfaces therebetween. The first and second sidewalls also have an outwardly extending interlock, the interlock extending upward and outward from the first lower vertical surface to the second upper vertical surface. The outward extension of the interlock and inward offset of the first upper vertical surface define corner spaces of the revetment block. The revetment block also having a top surface and a bottom surface and at least one aperture extending vertically through the revetment block. The top surface also having a smaller surface area than the bottom surface.

The revetment block further comprises at least one duct extending through the revetment block, preferably from a first end to a second end.

The revetment block may further comprise a dome disposed along the top surface. Extending through the revetment block may be at least one rectangular shaped aperture allowing growth from the marine floor to anchor the mat. The at least one aperture may have sidewalls tapering from a wider or larger upper portion to a narrower or smaller lower portion.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

The Revetment Block

Figure 1:
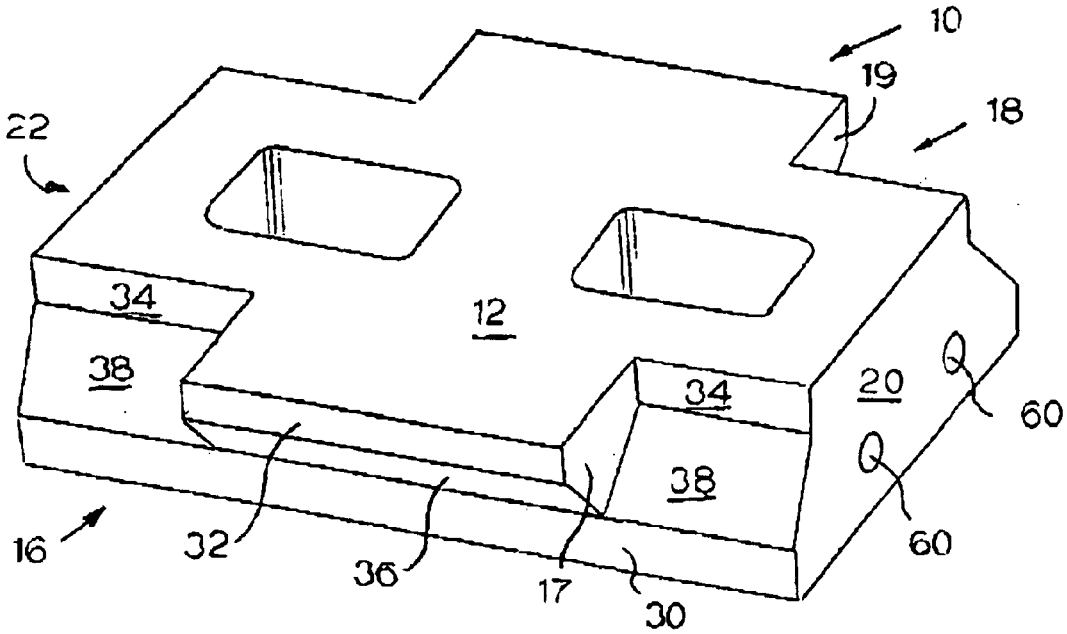
FIG. 1 shows a perspective view of the revetment block of the present invention.

The present invention will now be described in conjunction with the drawings, referring initially to FIG. 1, a revetment block 10 is shown. The revetment block 10 is substantially rectangular in shape but may be any other desirable shape. The revetment block 10 may be formed from precast concrete according to a first embodiment of the present invention and preferably has dimensions of about 18 inches×10 inches. Additionally, the height of the block may vary depending on the application and desired hydraulic characteristics, but is generally between about 2.75 inches and 9.5 inches. However, these dimensions may vary depending on the desired application and hydraulic characteristics. For example, when larger hydrodynamic forces are involved, the height of the block 10 may be increased.

Figure 2:
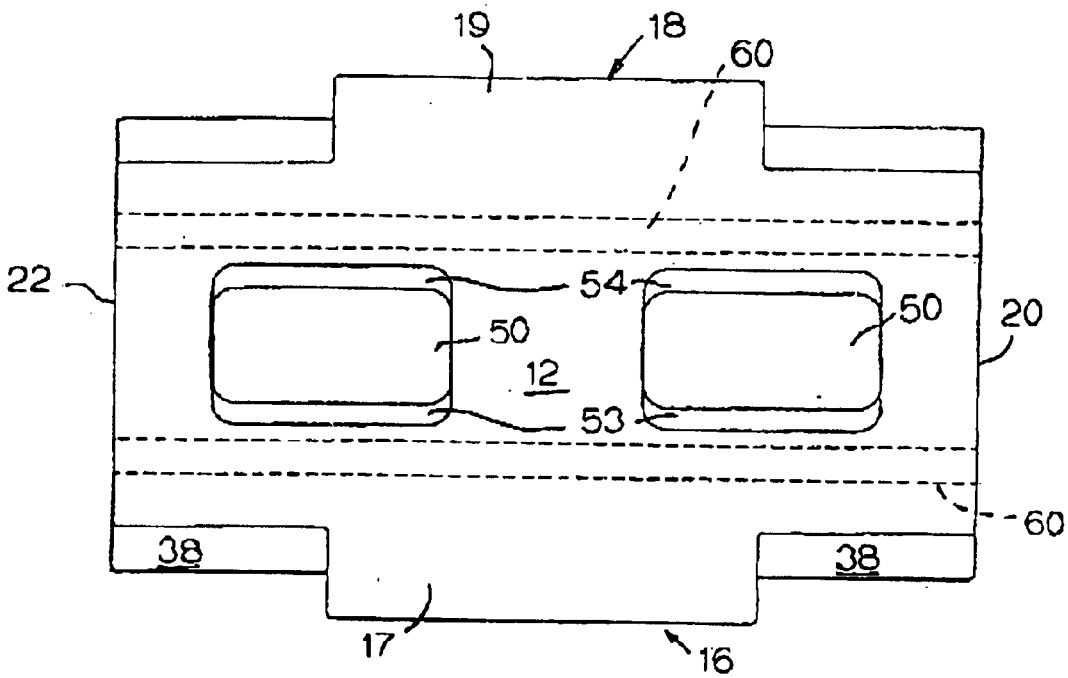
FIG. 2 shows a top view of the revetment block of FIG. 1.
Figure 3:
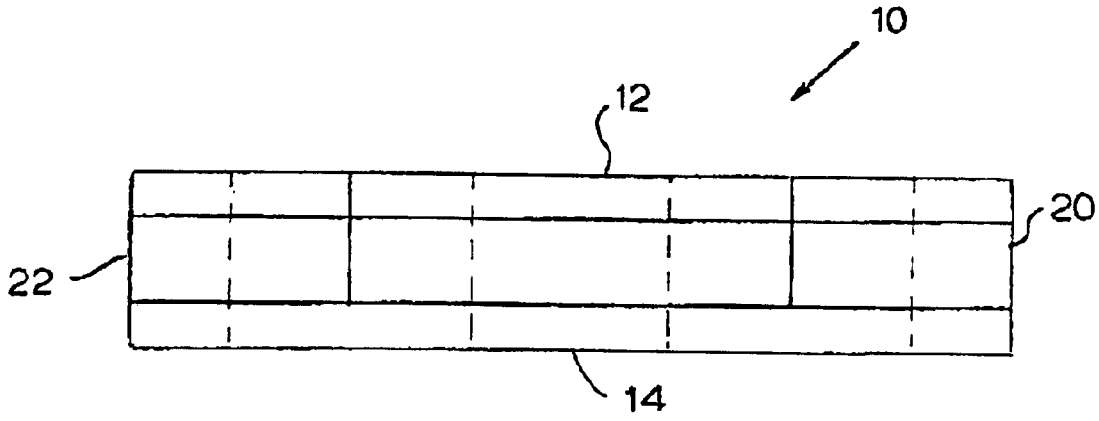
FIG. 3 shows front view of the revetment block of FIG. 1.
Figure 4:
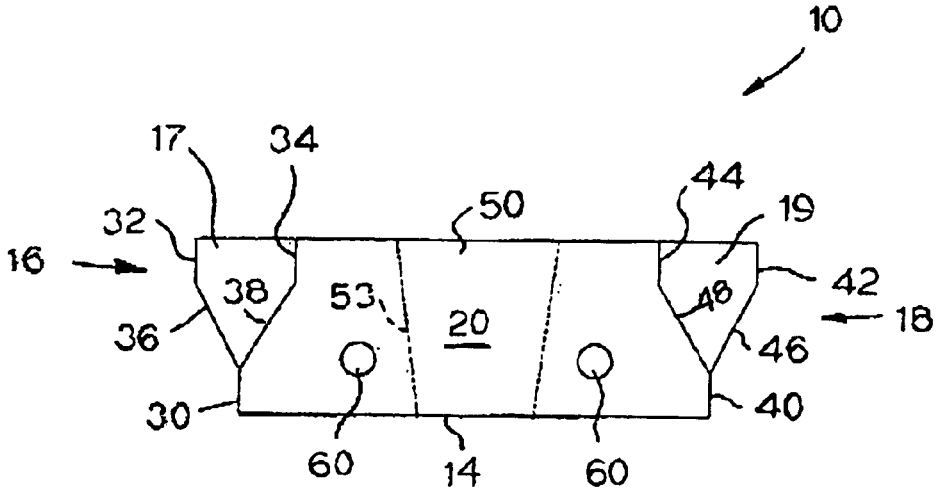
FIG. 4 shows an end view of the revetment block of FIG. 1.

Referring now to FIGS. 1–4, the revetment block 10 has a substantially planar upper or top surface 12 and lower or bottom surface 14, a first sidewall 16, a second sidewall 18, and first and second ends 20,22. Referring still to FIGS. 1–4, first sidewall 16 has a first lower vertical surface 30, a first upper vertical surface 32, and a second upper vertical surface 34. The first lower vertical surface 30 is offset from the first and second upper vertical surfaces 32,34. More specifically the first upper vertical surface 32 is offset outward from the lower vertical surface 30 and the second upper vertical surface 34 is offset inward from the lower vertical surface 30 as best seen in FIG. 4. This offset defines an interlock 17. The first upper vertical surface 32 is disposed on interlock 17 between second upper vertical surfaces 34 which are located at distal ends of sidewall 16. Between the first lower vertical surface 30 and the first upper vertical surface 32 is a first transition 36 which extends outward and upwardly connecting surfaces 30,32. This forms the interlock 17 extending from sidewall 16 which will partially overlap an adjacent block of a revetment mat 100, seen in FIG. 6, such that the blocks 10 cooperate to resist upward hydraulic pressure. Positioned between the first lower vertical surface 30 and the second upper vertical surface 34 of sidewall 16 is a second transition surface 38 extending upwardly and inwardly. Second upper vertical surface 34, transition surface 38 and the interlock 17 define a corner space on either side of interlock 17 wherein an interlock from an adjacent block may rest and inhibit upward movement of the block 10.

As best seen in FIG. 4, opposite first sidewall 16 is a second sidewall 18 symmetrically forming the revetment block 10. Second sidewall 18 also has a first lower vertical surface 40, a first upper vertical surface 42 and a second upper vertical surface 44. The first lower vertical surface 40 is offset from the first and second upper vertical surfaces 42,44. Like sidewall 16, the first upper vertical surface 42 is offset outward from the lower vertical surface 40 and a first transition 46 extends outward and upwardly connecting surfaces 40,42. This defines interlock 19. A second upper vertical surface 44 is offset inward from the lower vertical surface 40 and connected thereto by a second transition surface 38. The interlock 19, second upper vertical surface 44, and second transition 48 define a corner space wherein an adjacent interlock may be disposed. The first upper vertical surface 42 is disposed between second upper vertical surfaces 44 which are located at distal ends of sidewall 18. Interlock 19 extends from sidewall 18 and will partially overlap a corner space of an adjacent revetment block of a revetment mat 100, shown in FIG. 6, such that the revetment blocks 10 cooperate to resist upward hydraulic pressure. As shown in FIG. 2, interlocks 17,19 extend perpendicularly from sidewalls 16,18. In addition, the block 10 sidewalls 16,18 are both inwardly and outwardly extending thereby defining the corner space and the interlocks 17,19.

As best seen in FIG. 4 the sidewalls 16,18 have surfaces which are substantially parallel. For example, transition surface 36 is parallel to transition surface 48 and transition surface 38 is parallel to transition surface 46. With this design interlock 17 may be substantially disposed within the corner spaces of two adjacent blocks in a revetment mattress such as mattress 100. Interlock 19 can also fit within corner spaces of two adjacent blocks of a revetment mattress, for instance 100.

Figure 6:
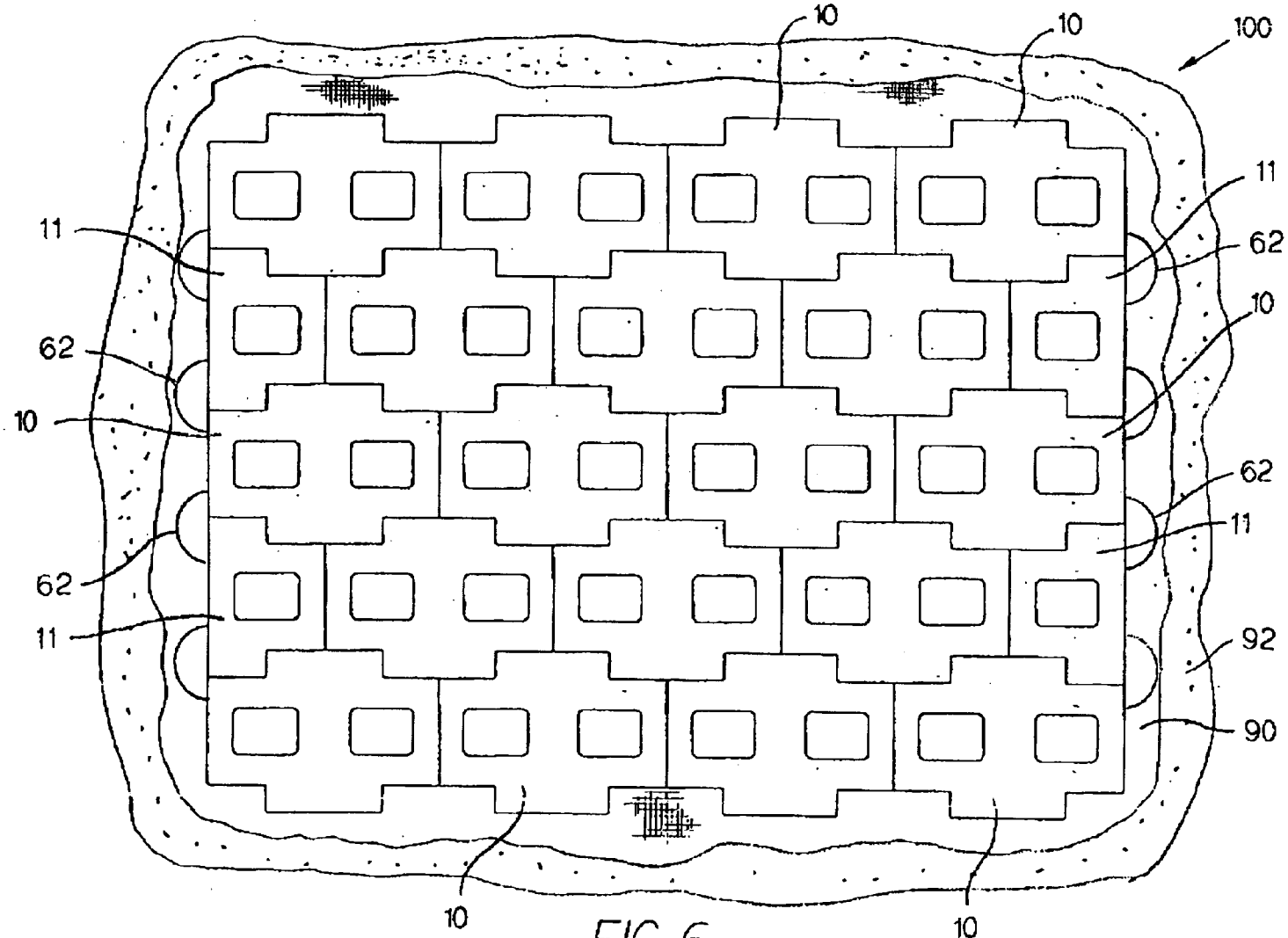
FIG. 6 shows a top view of a revetment mat formed by the revetment blocks of FIG. 1.

As shown in FIG. 3, the lower or bottom surface 14 of the revetment block 10 may be substantially flat or planar such as to make substantially continuous contact with either a substrate soil 92 or a filter fabric or media 90 which may preferably be located between the substrate soil 92 and revetment mat 100 shown in FIG. 6. In addition, the block 10 may have some gripping component built into the lower surface 14 to increase gripping efficiency between the block 10 and the filter media 90 or substrate soil 92.

The upper or top surface 12 of the revetment block 10 is preferably parallel with the lower surface 15 but may be designed differently depending on the application. As shown in FIGS. 1,2, and 4, the upper surface 12 may have first and second apertures 50 extending through the block 10 to the lower surface 14. The first and second apertures or openings 50 allows foliage to grow through the block 10 from the substrate soil 92 beneath the revetment mat 100 of FIG. 6. The foliage may provide an anchor for the mat 100 and has a second advantage of adding an aesthetically pleasing appearance to the waterway. Another advantage of the openings 50 is that the openings 50 relieve hydrostatic pressure which may build up beneath the revetment mat 100. The openings 50 allow water to flow through the blocks 10 thereby reducing upward lift on the revetment mat 100. One final advantage of the apertures or holes 50 is that they dissipate kinetic energy such as from waves which may buffet the revetment mat 100. The at least one aperture 50 preferably has equal proportions with apertures 50 of other revetment blocks 10 so as to provide an aesthetically pleasing appearance when a revetment mat is formed.

The openings 50 also have tapered walls 53 and 54 which provide the openings 50 with a substantially inverted frusto-pyramidal shape having an upper portion being larger than a lower portion. However, various other geometric shapes may be substituted to form the apertures 50. As seen in FIG. 2 the openings 50 are preferably symmetrically disposed about a longitudinal and a latitudinal axis of the revetment block 10.

The revetment block 10 also has first and second ends 20,22. The first and second ends 20,22 are parallel to each other and are preferably substantially perpendicular to sidewalls 16,18 thus forming the substantially rectangular block 10.

Extending between sides 20,22 are ducts 60. The ducts 60 are circular in shape and extend through the block 10 allowing a cable or rope to pass therethrough. When a plurality of blocks 10 are arranged to form a revetment mattress 100, the ducts 60 will be in alignment allowing a cable or rope to pass therethrough. Use of a cable or rope may be desirable for instance in lifting and placing the mattress 100 in a specific location. The ducts 60 are positioned in a manner so not to pass through apertures 50 and the foliage growing therein. The ducts 60 also allow water to flow through block 10 and thereby relieve hydrostatic pressure.

The interlocks 17,19 extending from the sidewalls 16,18 of block 10 cause the revetment mat 100 to be formed using a running bond, shown in FIG. 6. A running bond is formed when the blocks of a first row are offset and not longitudinally aligned with the blocks of an immediately adjacent row preventing formation of aligned columns. The running bond results in a revetment block 10 being in contact with at least four, and upto six, adjacent blocks and thereby having a more stable interlock and stronger mat 100.

As shown in FIG. 2, the interlocks 17,19 have a rectangular shape when viewed from above. The interlocks 17,19 may alternatively be curvilinear, U-shaped, angled, or otherwise configured so long as the spaced corners of block 10 operably receive half of the interlock therein. As seen in FIG. 6, the spaced corners of two adjacent blocks 10 have a size substantially equal to that of an interlock 17,19 wherein the interlocks 17,19 may disposed. The blocks 10 are preferably sized and manufactured wherein the revetment mats 100 may be formed of blocks of various manufacturing batches.

Figure 5:
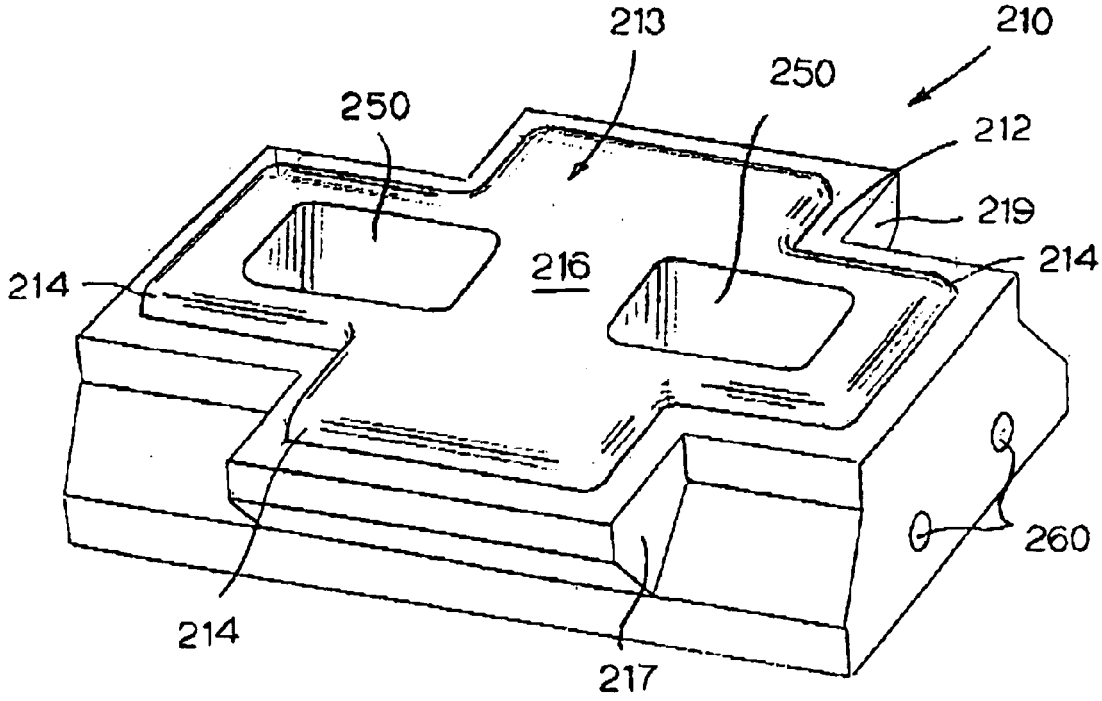
FIG. 5 shows perspective view of the revetment block of FIG. 1 having a dome on the top surface.
Figure 7:
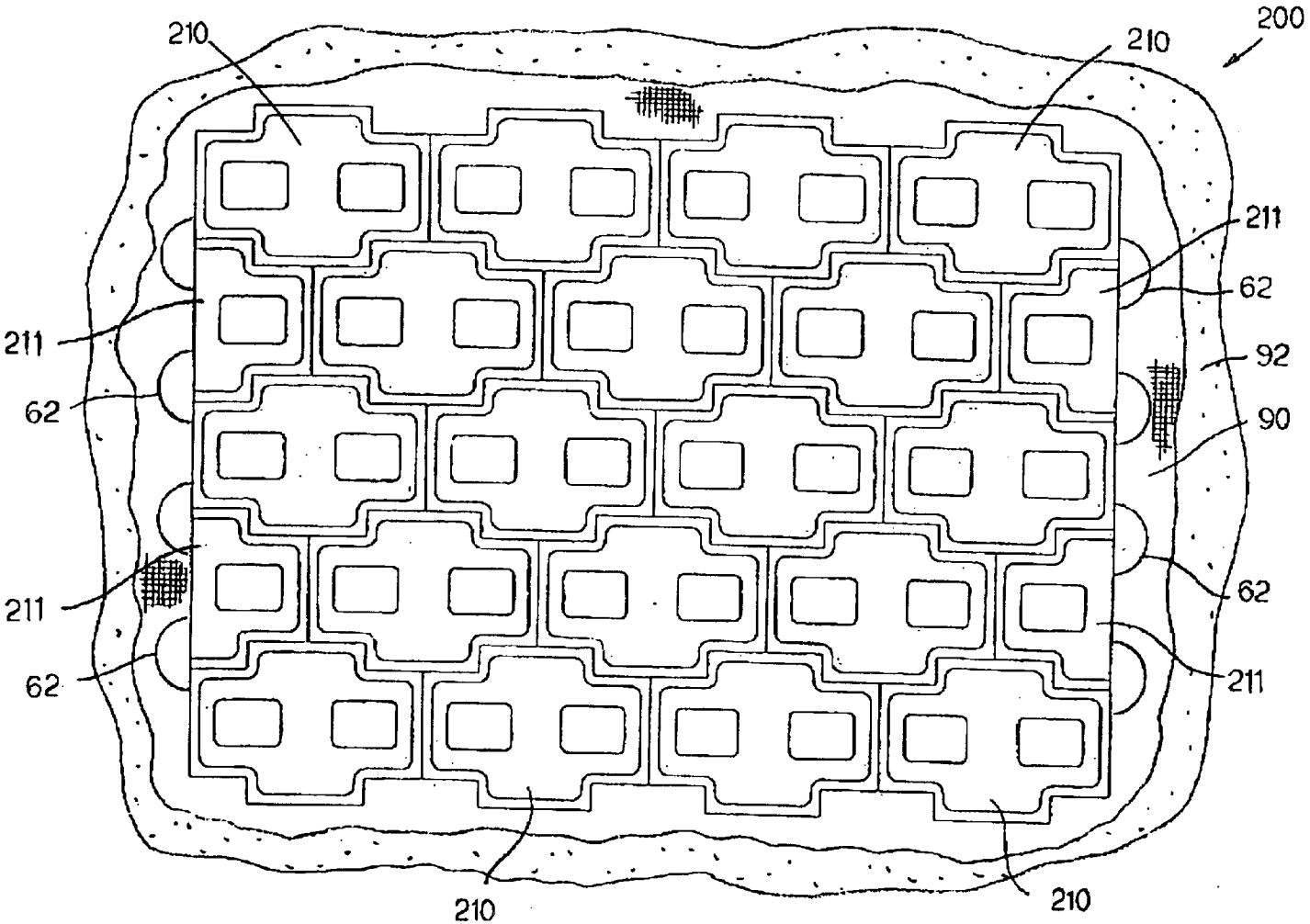
FIG. 7 shows a top view of a revetment mat formed by the revetment blocks of FIG. 5.
Figure 8:
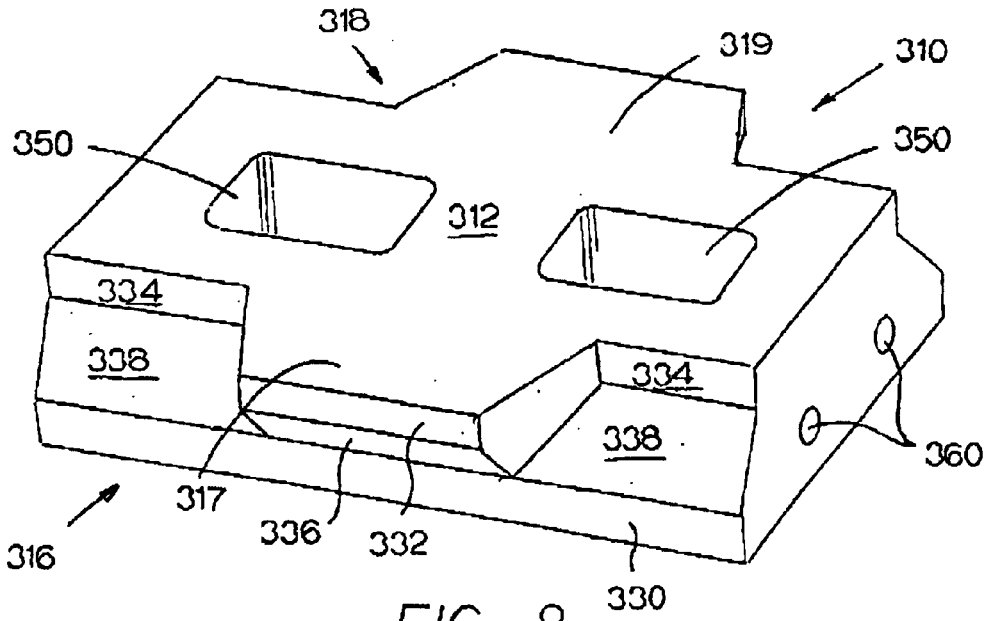
FIG. 8 shows a second embodiment of the revetment block of the present invention.
Figure 9:
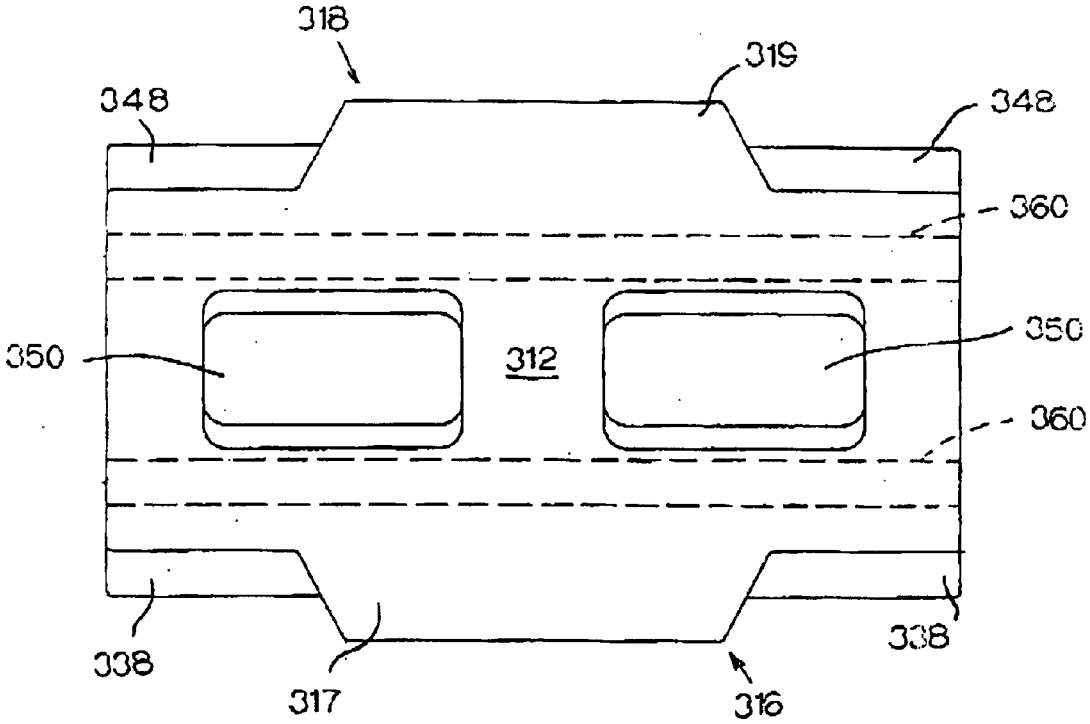
FIG. 9 shows a top view of the revetment block of FIG. 8.
Figure 10:
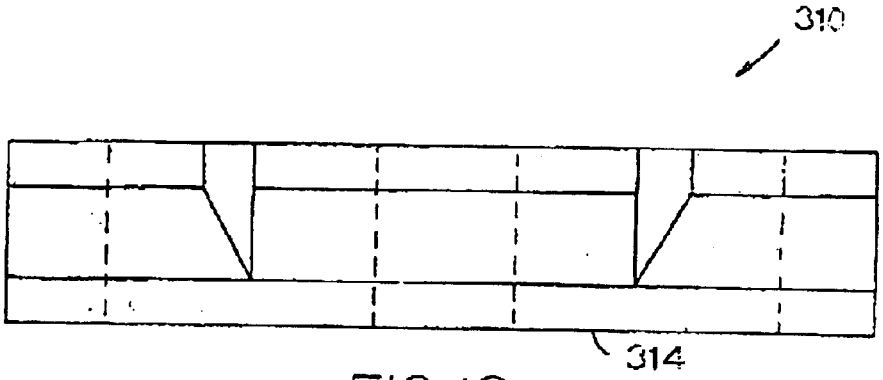
FIG. 10 shows a front view of the revetment block shown in FIG. 8.

Referring now to FIGS. 5 and 7, an alternative embodiment revetment block 210 is shown. Structurally the revetment block 210 is substantially equivalent to revetment block 10. However, the block 210 further comprises a dome 213 extending from top surface 212. The dome 213 is formed of precast concrete integral with block 210 and may have curvilinear walls or tapered walls 214 extending from the upper surface 212 to a dome top or an upper plateau 216. The dome top 216 is generally planar and parallel to a lower or bottom surface of block 210. Extending from the dome top 216 through the block 210 is at least one, preferably two, apertures 250 having a substantially rectangular shape. The apertures 250 may be of any desired shape allowing for growth of foliage therethrough and relieving hydraulic pressure from beneath a revetment mat 200. The apertures 250 may also provide the advantages described in the previous discussion of apertures 50 such as dissipating energy caused by waves. Revetment block 210 may also have a plurality of ducts 260 extending from a first end to a second end as shown in FIG. 5, wherein cable or rope 62 may be placed to interconnect revetment blocks.

The dome 213 provides a plurality of advantages for the block 210 and revetment mat 200. First the dome 213 reduces the velocity of water flow over the revetment mat 200. In turn kinetic energy of the water flow is dissipated and erosion is inhibited. Additionally, the slower flow across the mattress 200 may encourage some particulate matter to settle out on the mattress and within the apertures 250. Finally, the dome 213 also reduces the shear force caused by water moving above the revetment mat 200.

As seen in FIGS. 6 and 7 revetment mats 100,200 are shown formed of blocks 10,210 respectively. As one of ordinary skill in the art will understand, the running bond described above results in uneven alignment of alternating mat rows. Therefore half blocks 11,211 may be disposed at alternating row ends to CIO form evenly aligned row ends in mat 100,200. The half-blocks 11,211 may be formed by cutting blocks 10,210 in half or by molding the half-size block. The half blocks 11,211 preferably have ducts wherein cable or rope 62 may be placed forming loops to aid in lifting and placing the revetment mat in a waterway or elsewhere.

Referring now to FIGS. 8–11, a revetment block 310 is shown having interlocks 317,319. The interlocks 317,319 are defined by sidewalls 316,318 having vertical surfaces as well as inwardly and outwardly extending transition surfaces. More specifically sidewalls 316,318 are formed of a first lower vertical surface 330 and first upper vertical surfaces 332 and second upper vertical surface 334. As described above, the first lower vertical surface 330 and the first and second upper vertical surfaces are offset such that surface 334 is inwardly directed from surface 330. In addition surface 332 is outwardly directed from surface 330. Lower vertical surface 330 is connected to upper vertical surface 334 by transition surface 338. First lower vertical surface 330 is also connected to first upper vertical surface 332 by first transition surface 336 forming interlock 317. The interlock 317, transition surface 338, and vertical surface 334 define a typical corner space of block 310.

Figure 13:
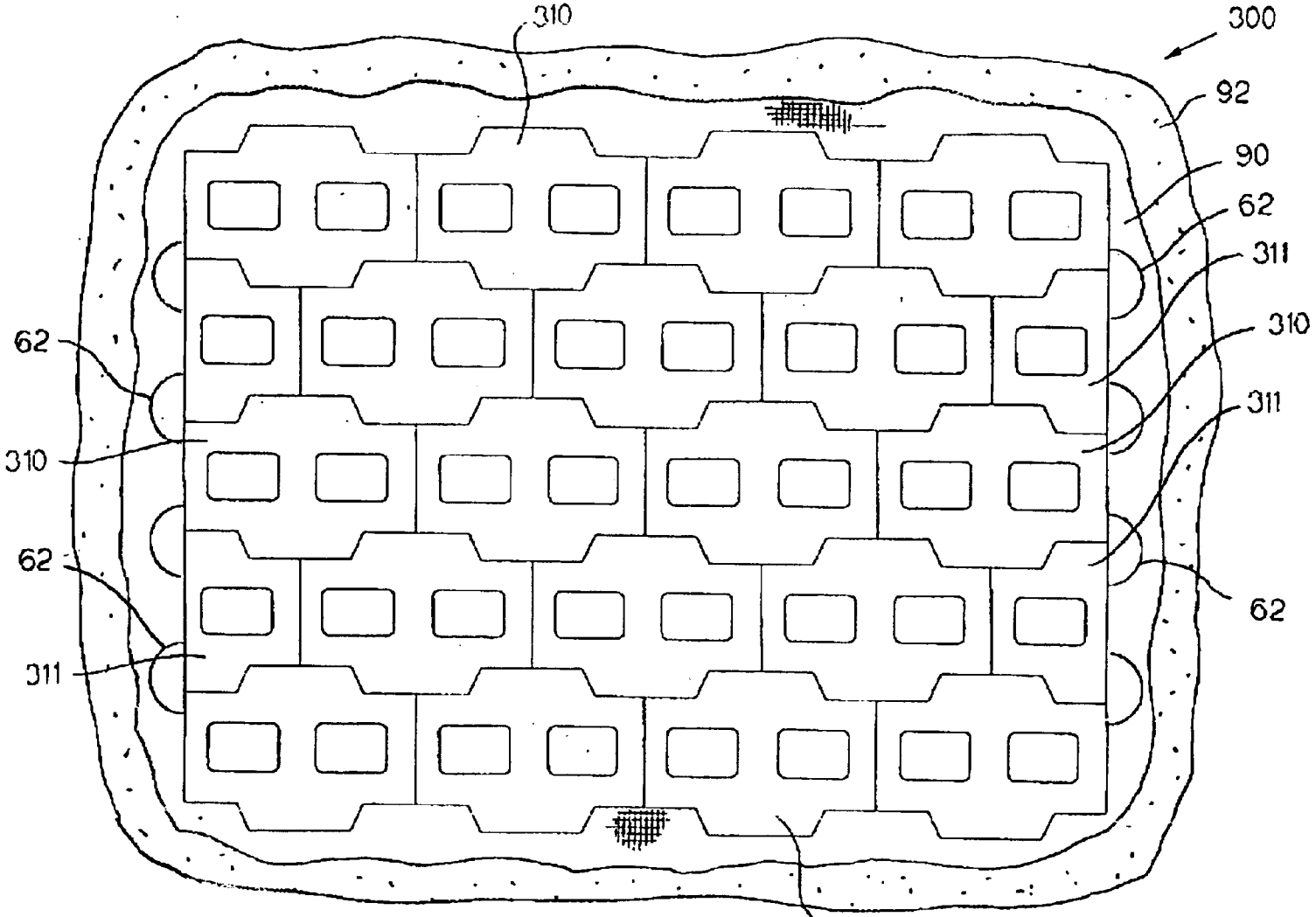
FIG. 13 shows a top view of a revetment mat formed by revetment blocks of FIG. 8; and, FIG. 14 shows a top view of a revetment mat formed by revetment blocks of FIG. 12.

As opposed to the revetment blocks 10,210 the revetment block 310 has tapered interlocks 317,319 extending outward at an angle instead of perpendicular as with blocks 10,210. The interlocks 317,319 are defined by the corner spaces of block 310, wherein one-half of an interlock 317,319 may be positioned. This provides for a running bond arrangement when a revetment mat 300 is formed, as shown in FIG. 13.

Figure 11:
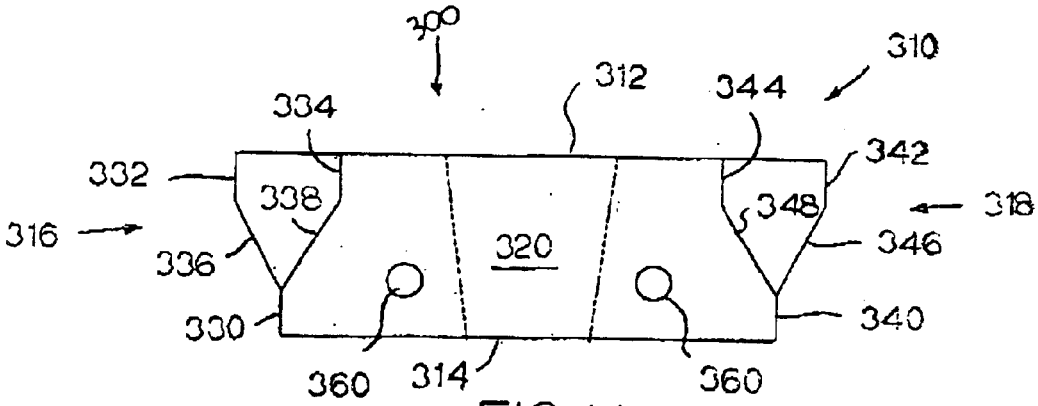
FIG. 11 shows a end view of the revetment block shown in FIG. 8.

As best seen in FIG. 11 the sidewalls 316,318 have surfaces which are substantially parallel. For example, transition surface 336 is parallel to transition surface 348 and transition surface 338 is parallel to transition surface 346. With this design interlock 317 can fit within the corner spaces of two adjacent blocks in a revetment mattress such as mattress 300. Interlock 319 can also fit within corner spaces of to adjacent blocks of a revetment mattress, for instance 300. Extending through the revetment block 310 may be a plurality of ducts 360 wherein a cable or rope 62 may be positioned to interlock a plurality of blocks.

The block 310 also has a top surface 312 and a bottom surface 314, which in addition to sidewalls 316,318 form the substantially rectangular shaped block 310.

Extending through block 310 from the top surface 312 to the bottom surface 314 are apertures 350. As described above, the apertures 350 may allow for settlement of particulate and relief of hydraulic pressure. As previously discussed the apertures 350 may be tapered having a larger upper portion and a smaller lower portion. In addition foliage may grow from beneath the revetment mat 300 and through apertures 350 thereby anchoring the mat 300 to the substrate soil 92.

Figure 12:
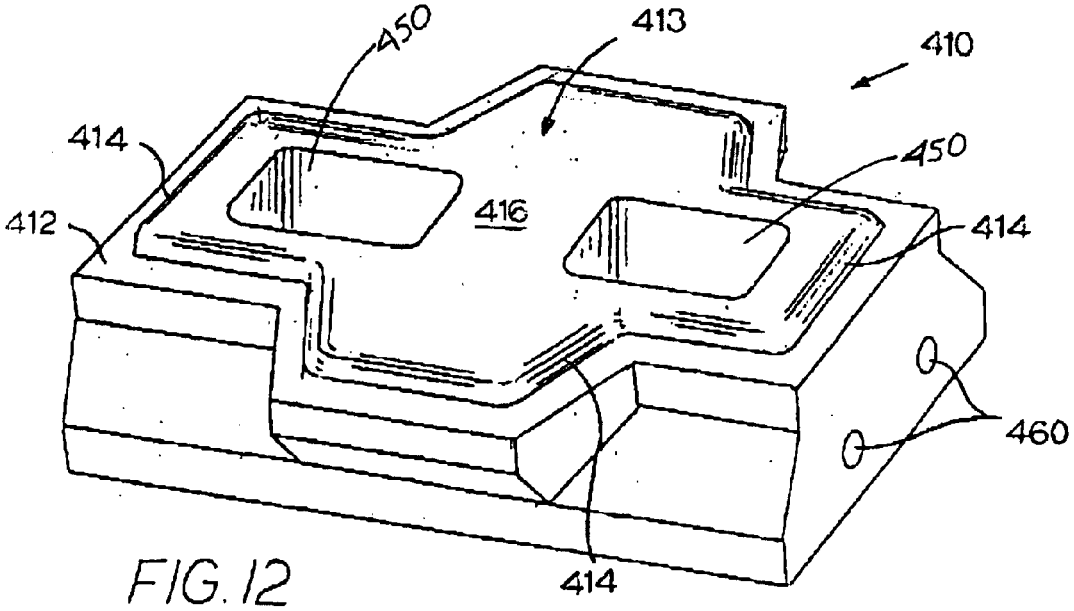
FIG. 12 shows a perspective view of the revetment block of FIG. 8 having a dome on a top surface.
Figure 14:
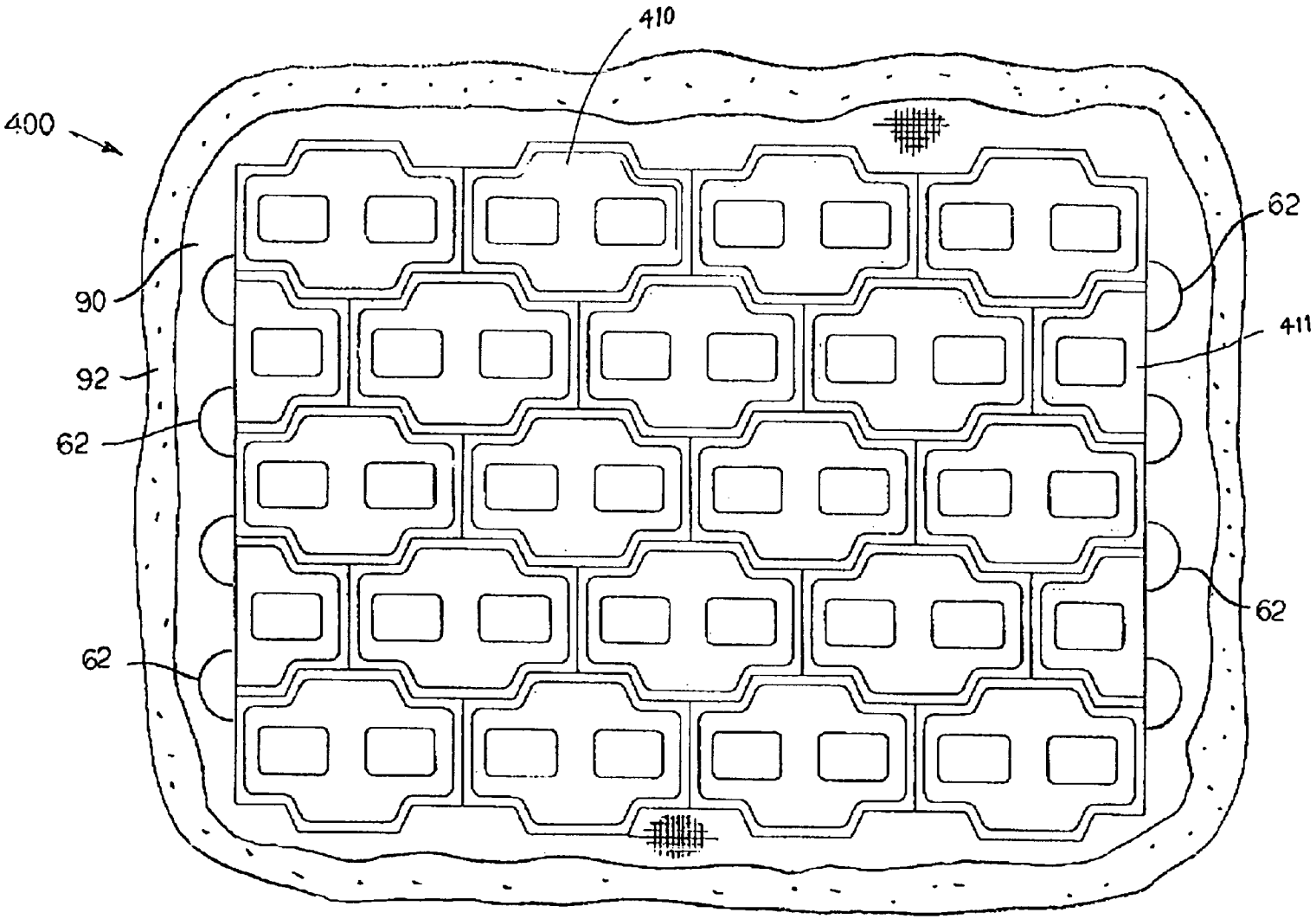

As shown in FIGS. 12 and 14, a revetment block 410 is structurally equivalent to revetment block 310 except a dome 413 extends from top surface 412. The dome 413 may have curvilinear or tapered walls 414 and an upper plateau or dome top 416. Extending from dome top 416 to the bottom of block 410 is at least one aperture 450. The apertures 450 allow foliage to anchor the revetment mat 400 as well as relieve hydraulic pressure from beneath the mat 400. The revetment block 410 may also have a plurality of ducts 460 extending therethrough wherein cable or rope may be positioned to interlock the revetment blocks 410.

The Revetment Mat

As described above the revetment mats 100,200,300,400 are formed of a plurality of revetment blocks 10,210,310, 410 respectively. The blocks 10,210,310,410 are arranged in a running bond pattern as previously described and shown in FIGS. 6,7,13,14. The blocks 10,210,310,410 are interlocked and contact at least four adjacent blocks. However, the running bond results in rows of uneven alignment when equal numbers of blocks are used in each row. More specifically, alternating rows are a half block too short at each end and require a half block 11,211,311,411 be added thereto.

The revetment mattress 100,200,300,400 may be constructed row by row until a desired size matrix is obtained. Preferably, the construction of the mattress 100,200,300,400 occurs at a manufacturing facility but may, instead occur at the site of the mattress installation. When adjacent rows are completed, a cable or rope 62 is positioned through the ducts, for instance ducts 60. The end to end positioning of blocks 10 provides alignment of the ducts, for instance ducts 60, of the plurality of blocks 10 to be aligned. As previously discussed, the use of half-sized blocks, for instance 11, in addition to full size blocks, such as 10, allows for a mattress having evenly aligned edges.

Once the precast blocks are constructed into a mattress 100, a cable 42 is used to interlock the rows of mat 100. Preferably each cable 62 extends through a first mattress row and loops around through an adjacent second row, however various other methods of interlocking the mattress may be used. With two ducts per row each row can be interconnected with an adjacent row on each side. The cable is preferably stainless steel but may alternatively be made of galvanized stainless steel, or high strength polyester rope. Additionally, the cable or rope 62 should exhibit excellent resistance characteristics to most acids, alkalis, and solvents and should also be impervious to rot, mildew, and microorganisms associated with marine environs. At each duct, for example 60, a washer 64 and a sleeve 66 may be placed on the cable 62 where it enters and exits the revetment mat 100,200,300,400 as shown in FIGS. 6,7,13,14. The sleeves 44 are preferably crimped on the cable 62 adjacent the ducts 60 so that free movement of the cable 62 through the mattress 100,200,300,400 is inhibited. This process is continued until the mattress 100 is fully constructed.

Once this is completed, a filter medium or filter fabric 90 is placed over the substrate soil 92 where the mattress 100 will be located. The filter fabric 90 inhibits erosion of the substrate soil 92 and is preferably made of a geotextile comprising a synthetic polymer such as propylene, ethylene, ester, or amide and inhibitors to resist deterioration due to ultraviolet and heat. Once the filter fabric 90 is positioned the mattress 100,200,300,400 is moved by crane or other lifting moved, preferably with the aid of a spreader bar, to a position above the filter fabric 90. Finally, the mattress 100,200,300,400 is lowered into the waterway, ramp, or channel and placed on top the filter fabric 90. In the alternative, the mat 100,200,300,400 may be constructed at the construction site instead of at a manufacturing facility. As discussed earlier, the blocks comprising mattress may have projections on a lower surface 15 increasing shear force resistance to the moving water.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A revetment block, comprising:

a substantially rectangular block having a top surface and a bottom surface;

a first end and a second end extending vertically between said top surface and said bottom surface; and, a first sidewall and a second sidewall each having an upper vertical surface and a lower vertical surface and inwardly and outwardly extending transition surface between said upper vertical surface and said lower vertical surface.

2. The revetment block of claim 1, wherein said first and said second sidewall and said transition surfaces define an interlock extending outwardly normal to said at least one vertical surface.

3. The revetment block of claim 1, wherein said first end and said second end are substantially parallel and said first and second sidewalls are substantially parallel.

4. The revetment block of claim 1 further comprising a first aperture and a second aperture extending from said top surface through said block.

5. The revetment block of claim 4, wherein said first aperture and said second aperture have first and second tapered walls and wherein an upper portion of said first and second apertures is larger than a lower portion of said first and second apertures.

6. The revetment block of claim 1 further comprising a dome extending from said revetment block top surface.

7. The revetment block of claim 6, said dome having a curvilinear wall extending from said top surface to a dome top surface.

8. The revetment block of claim 1 having a plurality of ducts extending through said revetment block.

9. The revetment block of claim 8 said plurality of ducts extending from said first end to said second end of said revetment block.

10. A revetment block, comprising:

a substantially rectangular block having a top surface and a bottom surface;

a first end and a second end extending vertically between said top surface and said bottom surface;

a first sidewall and a second sidewall each having an upper vertical surface and a lower vertical surface and inwardly and outwardly extending transition surfaces between said upper vertical surface and said lower vertical surface;

said first sidewall and second sidewall each having a first corner space and a second corner space defining an interlock, said interlock extending from said first sidewall and said second sidewall normal to said upper and lower vertical surfaces; and, a dome extending from said top surface and having curvilinear walls.

11. The revetment block of claim 10, wherein said first and second ends are substantially parallel and said sidewalls are substantially parallel.

12. The revetment block of claim 10 further comprising a first and a second aperture extending from said dome upper plateau through said bottom surface of said block.

13. The revetment block of claim 10, wherein said first and said second apertures have first and second tapered walls and wherein an upper portion of said apertures is larger than a lower portion of said apertures.

14. The revetment block of claim 10 having a plurality of ducts extending through said revetment block.

15. The revetment block of claim 14 said plurality of ducts extending from said first end to said second end of said revetment block.

16. A revetment mat, comprising:

a plurality of revetment blocks having a first sidewall and a second sidewall including interlocks extending from said sidewalls and corner spaces in said revetment blocks;

said first sidewall and said second sidewall each having an upper vertical surface and a lower vertical surface and inwardly and outwardly extending transition surfaces between said upper vertical surface and said lower vertical surface;

said first and second sidewalls being opposed sidewalls, said opposed sidewalls each having inwardly and outwardly extending transition surfaces defining said interlocks;

said interlocks engaging said corner spaces of blocks of an adjacent row;

a mattress formed of a plurality of rows of said revetment blocks in a running bond configuration.

17. The revetment mat of claim 16 further comprising at least one cable extending through said rows of said mattress.

18. The revetment block of claim 16 wherein said mattress further comprises half-size revetment blocks on alternating rows.

19. A revetment block, comprising:

a substantially rectangular revetment block having tapered interlocks extending from a first sidewall and a second sidewall;

said first sidewall and said second sidewall each having an upper vertical surface and a lower vertical surface and inwardly and outwardly extending transition surfaces between said upper vertical surface and said lower vertical surface;

said tapered interlocks defining corner;

said interlocks and said corner spaces being sized to operably engage adjacent rows of revetment blocks and form a revetment mattress.

20. The revetment block of claim 19 having apertures extending from a top surface to a bottom surface.

21. The revetment block of claim 19 having a plurality of ducts extending from a first end to a second end of said revetment block.

22. The revetment block of claim 19 having a dome extending from a top surface.

23. The revetment block of claim 22, said dome having curvilinear walls.

24. A revetment block, comprising:

a substantially rectangular block having a top and a bottom surface;

a first end and a second end extending vertically between said top surface and said bottom surface;

a first sidewall and a second sidewall each having an upper vertical surface and a lower vertical surface and inwardly and outwardly extending transition surfaces between said upper vertical surface and said lower vertical surface;

said first sidewall and said second sidewall each having at least one tapered interlock extending from said at least one vertical surface.

25. The revetment block of claim 24 wherein said first end and said second end are substantially parallel and wherein said first sidewall and said second sidewall are substantially parallel.

26. The revetment block of claim 25 wherein a first aperture and a second aperture extend from said top surface and through said bottom surface.

27. The revetment block of claim 24 further comprising ducts extending from said first end to said second end.

28. The revetment block of claim 24 further comprising a dome extending form said top surface.

29. A revetment block comprising:

a substantially rectangular block having a top surface and bottom surface;

a first and a second end extending vertically between said top surface and said bottom surface;

a first sidewall and a second sidewall each having an upper vertical surface and a lower vertical surface and inwardly and outwardly extending transition surface between said upper vertical surface and said lower vertical surface;

said first and second sidewalls each having at least one interlock extending in a tapered manner from said at least one vertical surface; and, a dome extending from said top surface.

30. The revetment block of claim 29, further comprising a plurality of corner spaces defined by said tapered interlock, each of said plurality of corner spaces having a transition surface and a vertical surface therein.

31. The revetment block of claim 29 further comprising a first aperture and a second aperture having at least two tapered walls.

32. The revetment block of claim 29 having a plurality of ducts extending between said first end and said second end.

33. A revetment block, comprising:

a substantially rectangular revetment block having tapered interlocks extending from a first sidewall and a second sidewall;

said first sidewall and said second sidewall each having an upper vertical surface and a lower vertical surface and inwardly and outwardly extending transition surfaces between said upper vertical surface and said lower vertical surface;

said tapered interlocks defining corner spaces having tapered and vertical surfaces therein;

said interlocks and corner spaces being sized to operably engage revetment blocks of adjacent rows and form a revetment mattress.

34. A revetment mat, comprising:

a plurality of revetment blocks having a first sidewall and a second sidewall, said first sidewall and said second sidewall each having an upper vertical surface and a lower vertical surface and inwardly and outwardly extending transition surfaces between said upper vertical surface and said lower vertical surface, and tapered interlocks extending from said sidewalls defining four corners spaces in said revetment blocks;

said interlocks engaging said corner spaces of revetment blocks of an adjacent row forming a running bond;

said mattress formed of a plurality of rows of said revetment blocks.

35. The revetment mat of claim 34, wherein said plurality of rows are interconnected by at least one cable extending through said plurality of blocks.

36. A revetment block, comprising a first end and a parallel second end extending between a top surface and a bottom surface;

said first sidewall and said second sidewall each having an upper vertical surface and a lower vertical surface and inwardly and outwardly extending transition surfaces between said upper vertical surface and said lower vertical surface;

said first and second sidewalls each defining an interlock and a corner space.

37. The revetment block of claim 36, said interlock extending outward from said sidewall normal to said upper vertical surface.

38. The revetment block of claim 36, said interlock extending outward from said upper vertical surface and being tapered.

* * * * *